United States Patent [19]

Shamszadeh

[11] Patent Number: 4,517,782

[45] Date of Patent: May 21, 1985

[54] CONSTRUCTION ELEMENT

[75] Inventor: Khosrow Shamszadeh, Bethayres, Pa.

[73] Assignee: Nadalaan S.A., Geneva, Switzerland

[21] Appl. No.: 330,517

[22] Filed: Dec. 14, 1981

[30] Foreign Application Priority Data

Dec. 12, 1980 [CH] Switzerland ..... 9178/80

[51] Int. Cl.[3] ..... E04C 1/00

[52] U.S. Cl. ..... 52/309.7; 52/309.2; 52/452; 52/600; 428/319.1

[58] Field of Search ..... 52/309.7, 309.8, 309.16, 52/309.17, 450–452, 449, 443, 600; 428/319.1, 139, 140, 703

[56] References Cited

U.S. PATENT DOCUMENTS

| | | | |
|---|---|---|---|
| 782,810 | 2/1905 | Murphy | 52/452 |
| 1,115,593 | 11/1914 | Sexton | 52/447 |
| 1,296,525 | 3/1919 | Jensen | 52/443 |
| 2,020,639 | 12/1935 | Grayson et al. . | |
| 2,049,863 | 4/1936 | Palmer | 52/451 |
| 2,245,688 | 6/1941 | Krueger | 52/450 |
| 2,616,283 | 11/1952 | Branstrator | 52/601 |
| 2,934,934 | 5/1960 | Berliner | 52/601 |
| 3,154,888 | 11/1964 | Graham | 52/88 |
| 4,227,356 | 10/1980 | Stern | 52/451 |
| 4,241,555 | 12/1980 | Dickens | 52/309.17 |
| 4,263,752 | 4/1981 | Jungbluth | 52/309.17 |

FOREIGN PATENT DOCUMENTS

| | | | |
|---|---|---|---|
| 1609629 | 8/1970 | Fed. Rep. of Germany . | |
| 2264347 | 12/1972 | Fed. Rep. of Germany | 52/309.7 |
| 2159951 | 6/1973 | Fed. Rep. of Germany . | |
| 2521143 | 11/1976 | Fed. Rep. of Germany . | |
| 2542529 | 7/1977 | Fed. Rep. of Germany . | |
| 2642388 | 3/1978 | Fed. Rep. of Germany | 52/449 |
| 2032979 | 11/1970 | France . | |
| 2316402 | 1/1977 | France . | |
| 2361512 | 3/1978 | France . | |
| 642712 | 6/1962 | Italy | 52/450 |
| 1130727 | 10/1968 | United Kingdom . | |

*Primary Examiner*—Henry E. Raduazo

*Attorney, Agent, or Firm*—Young & Thompson

[57] ABSTRACT

A construction element comprises a ribbed sheet metal core whose ribs are of trapezoidal cross section, at least partially embedded in plastic foam. Fretwork extends along the tops of the ribs, transversely or longitudinally thereof. Transversely, the fretwork can be spaced metal straps or wooden slats. Longitudinally, the fretwork can be undulant or twisted metal strips. The fretwork can be embedded in the plastic foam, or can disposed outside and spaced from the plastic foam so as to serve to improve the connection between the construction element and a layer of concrete cast thereon. The construction elements have overlapping edges of reduced thickness into which the metal core extends. The ends of the construction elements have Z-shaped members one wing of which is secured to the core and the other wing of which serves to secure the element to a support.

6 Claims, 11 Drawing Figures

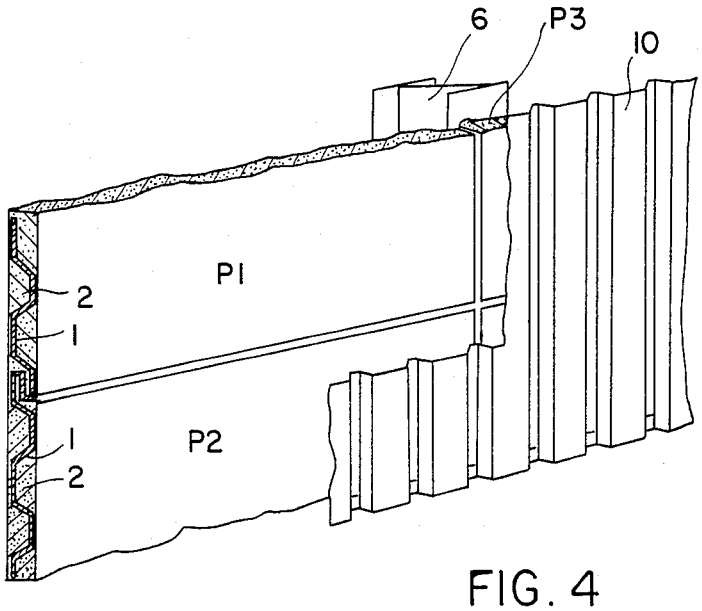
FIG. 4
FIG. 5
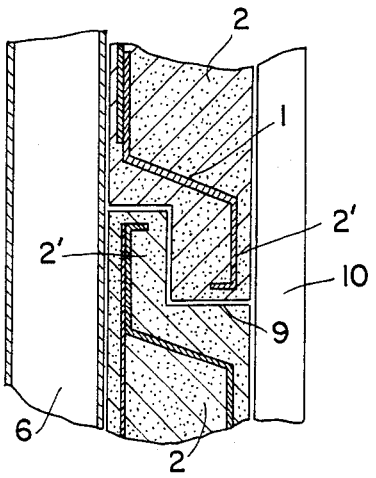
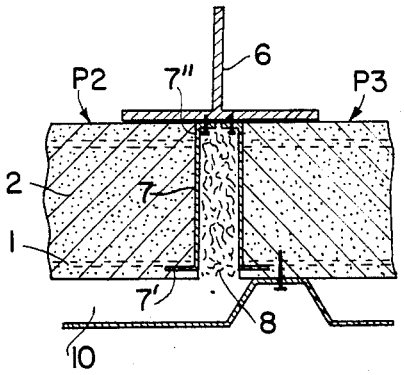
FIG. 6

CONSTRUCTION ELEMENT

The present invention relates to a construction element of many uses, which can be used in any type of construction such as walls, sheathing, exterior insulating panels for existing constructions, ceilings, floors, etc.

Insulating construction panels are already known that have many uses, generally constituted by two skins between which an insulating material is confined. However, these panels have certain drawbacks, among which is the fact that their possible number of uses is limited because of the unavoidable presence of the two external skins, which constitutes a double disadvantage both from the point of view of appearance and from the point of view of cost. Moreover, thermal bridges may be provided by these known constructions when mounted in place, and this greatly decreases their thermal insulation characteristics.

It is an object of the present invention to overcome these difficulties. To do this, the present invention provides a construction element characterized by the fact that it comprises a rigid core which is at least partially embedded in an insulating material, each of the faces of the construction element being at least partially formed by the insulating material.

The accompanying drawings show schematically and by way of example several embodiments of construction element acccording to the invention as well as their possible uses.

In the drawings:

FIG. 4 is a fragmentary perspective view of construction elements according to the present invention used as sheathing;

FIGS. 5 and 6 are respectively vertical and horizontal enlarged fragmentary cross-sectional views of FIG. 4;

Figure 1:
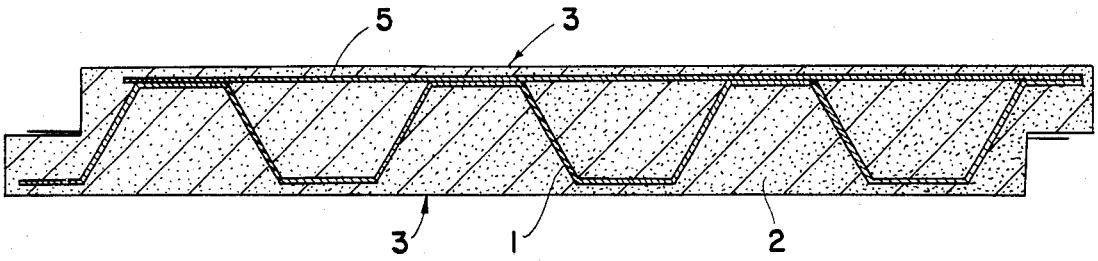
FIGS. 1, 2 and 3 are cross-sectional views of three alternative embodiments of construction element according to the present invention.
Figure 2:
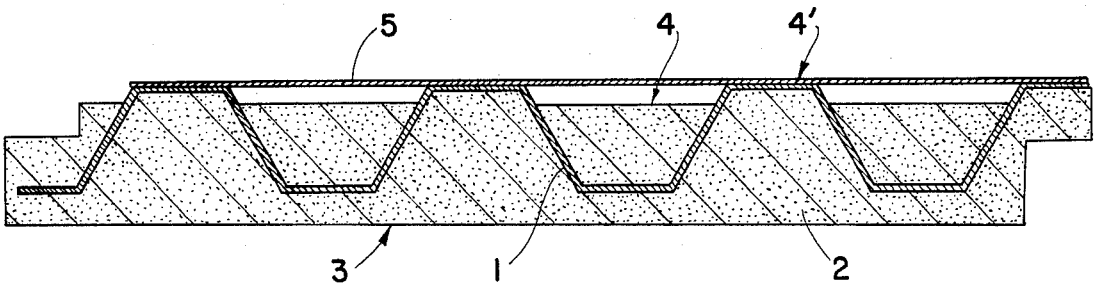
Figure 3:
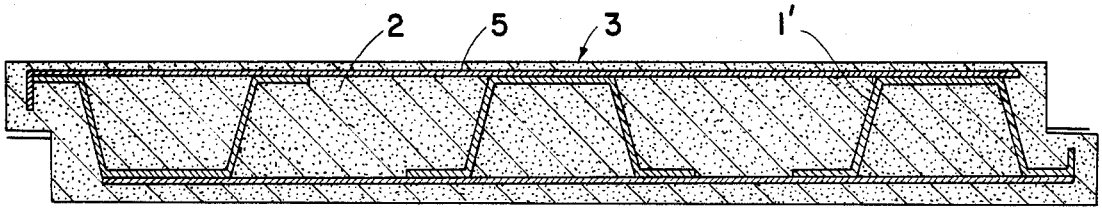

Referring now to the drawings in greater detail, and first to the embodiments of FIGS. 1–3, it will be seen that the construction element according to the present invention comprises a metallic core providing a rigid armature and constituted by a ribbed metal profile 1 (FIGS. 1 and 2) or by several ribbed profiles 1' (FIG. 3). These profiles may be formed of rolled sheet steel, aluminum, lead, or any other suitable metallic alloy according to the envisioned use; and the parallel ribs have in cross section a substantially trapezoidal configuration, the depth of the ribs being in this case substantially equal to the width of their tops. According to other embodiments which are not shown, the rigid armature functioning as the core of the construction element may also be provided in other rigid materials, such as wood, plastics, etc. Of course, the characteristics of the metallic or nonmetallic core will be chosen as a function of the moment of inertia sought for the particular use in question.

The metallic core 1, 1' is embedded in a synthetic insulating material 2, for example a rigid or flexible cellular foam, such as polyurethane, or bonded fibers or any other thermal and/or sound insulating material. This covering material is disposed on both sides of the metallic core 1, 1' so as to form at least partially the two exposed faces 3 of the panel. These two faces 3 may be constituted entirely by the covering material 2 (FIGS. 1 and 3) or else one of the faces 3 is entirely constituted by that material, the other face 4, 4' being only partially constituted by that material (FIG. 2). In this latter case, the surface of the panel has portions 4 of covering material and portions formed by a part 4' of the metallic profile.

According to alternative embodiments which are not shown, a portion of the longitudinal throats of the profiles may be replaced by an inexpensive filling material which is then embedded in the covering material.

According to the uses foreseen for the construction element of the present invention, the metallic core 1, 1' may be provided with a protective coating or a coating to improve its adherence with the insulating material 2. It can also have perforations or embossing so as mechanically to reinforce the bond between the core and its cladding.

The apices of the ribs of the profiles 1, 1' may be interconnected, on one or both faces of the construction element, by cross pieces 5 that extend transversely and are suitably spaced apart from each other. The cross pieces 5 may be constituted for example by metallic strips fixed by welding or crimping, or by wooden slats, etc., and serve on the one hand to increase the rigidity of the element, and on the other hand as connectors useful for handling the construction element, for securing its facings, for bonding to cladding material, etc.

One of the important advantages of the construction element according to the invention resides in the fact that one or both of its faces may be provided with any kind of covering, according to the desired utilization. The "hot" face of the panel may be covered by a so-called "vapor barrier", for example of kraft paper, aluminum, aluminum paper, a film of polyvinylchloride or of polyethylene, etc. As to the "cold" face, this may be likewise provided, according to the intended use of the panel, with a decorative or finishing or protective coating.

Thus, thanks to the possibility of combining the construction element according to the present invention with an almost unlimited range of functional or aesthetic facings, this element may have multiple uses in all fields and types of architecture. Among others could be mentioned the use of this construction element for providing insulating panels for industrial sheathing, waterproof or covering supports, walls, floors, external insulating panels for existing constructions, walls for refrigerator chambers, bathrooms, etc. Some of these recited uses will now be described in greater detail by way of example with reference to FIGS. 4–11.

The first use, shown in FIGS. 4–6, is as sheathing comprising a vertical series of construction elements ($P_1$, $P_2$, $P_3$, etc.), the ribs of the profiles being disposed horizontally, fixed to upright beams 6. At each end 2', each panel $P_1$, $P_2$, $P_3$, etc. comprises a Z-shaped closure profile 7, for example of galvanized steel, whose one flange 7' is secured, by crimping, spot welding, etc., on the tops of the ribs of the metallic core 1, the other flange 7'' serving as a lip for securement to the vertical beam 6. At the vertical junction of two horizontal panels $P_1$, $P_3$, a filler 8 is provided between the two end profiles 7, this filler being for example a flexible joint, a rigid foam, a pad of glass fiber, etc. (FIG. 6).

The horizontal joint between two horizontal panels $P_1$, $P_2$ is formed by the superposition of the side edges 2'.

A sealing joint material may also be provided at 9 between the panels.

When a panel must be secured to more than two vertical supports, the intermediate connectors may be provided externally or internally, for example by means of self-tapping screws. When the securement is external, the head of the fastener will be covered by an insulating plug, for example of foam, so as to preserve the continuity of the thermal insulation.

Thanks to the fact that it permits obtaining sheathing with no thermal bridge, the construction element according to the invention, used as sheathing, has with respect to known sandwich panels the advantage of being adaptable for many uses and of being useful under all climatic or aesthetic conditions.

Thus, the "hot" face of the element may be covered by a material dictated by the use of the internal wall of the construction and particularly according to aesthetic standards. The interior covering therefore may be plain, grained, striated, of metallic appearance or not, etc., in contradistinction to known panels in which the interior covering must also function as the rigid armature and may display ribs or reinforcements as the case requires.

The external covering, which will preferably be water-tight, is also chosen according to the type of construction as well as according to economic, aesthetic, climatic and other considerations. In the example illustrated in FIGS. 4–6, a metallic or plastic profile 10 is used as external facing and is fixed to the construction element according to the invention for example by securement to the tops of the ribs of the metallic core 1. In the case of horizontal sheathing, the external covering may also be fixed to the transverse cross pieces.

All types of external covering may be used, thanks to the metallic profiles, for example asbestos cement slabs, slate shingle, plastic profiles, face coats, etc. It is also possible to provide, as external facings, elements of low moment of inertia, which thus permit increasing in an important way the possibilities of architectural style.

Moreover, such a construction imparts protective characteristics, for example acoustic, shock absorbing, etc., at selected portions of the facing, which accordingly do not affect the entire construction.

Finally, thanks to the profiled core of the construction elements when used as sheathing, the bracing of the latter is ensured without the need to use other rigidifying or reinforcing elements.

For providing an insulating support for coverings with construction elements according to the invention, these may be assembled and secured to the joists of the roofing in the same manner as described above for the emplacement of sheathing on upright beams. Once installed, the construction elements according to the present invention are ready to receive any kind of traditional covering.

Figure 7:
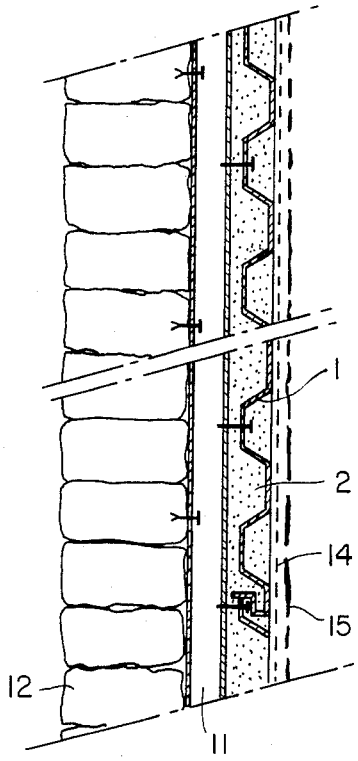
FIGS. 7 and 8 are cross-sectional views of construction elements according to the present invention shown in use as external insulating panels.
Figure 8:
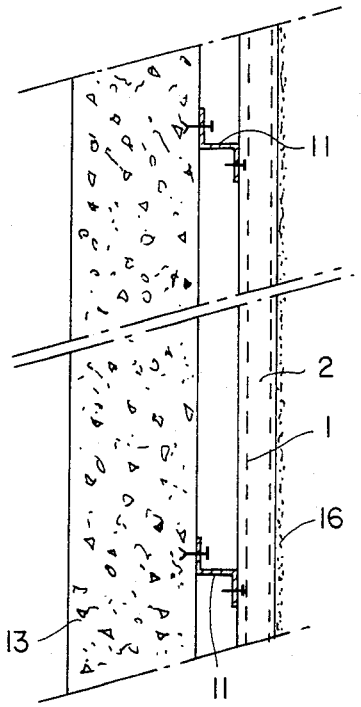

FIGS. 7 and 8 show the use of construction elements according to the invention as exterior insulating panels for existing constructions. The construction elements are thus fixed to the facade by means of Z-shaped purlins 11. These purlins 11 may be secured by means of pins, nails, screws or crimping, vertically or horizontally as desired, against the brick wall 12 or against a concrete wall 13 (FIGS. 7 and 8). In the first case, the construction elements are assembled with the ribs of profile 1 disposed horizontally; while in the second case, the ribs of profile 1 are disposed vertically. The securement of the elements of construction on Z-shaped purlins is effected by nailing, screwing or crimping on the tops of the ribs of profile 1. The assembly of the construction elements with each other is effected in the same manner as described in connection with FIGS. 4–6 showing the use of industrial sheathing.

As to the external face of the construction elements, this may be provided for example with screen 14 to receive a cement layer 15 (FIG. 7) or else glass fiber or other support material designed to receive a plaster layer 16.

When designed for use as a simple external insulating panel to be secured to the facade, the construction element according to the present invention need not have itself a high moment of inertia other than that necessary to resist climatic chances at the work site without substantially sagging. However, the presence of an armature even of low moment of inertia suffices to confer on the insulating panel sufficient rigidity so that it can be stocked in large units and will nevertheless remain easy to handle. This is a great advantage when compared to other products in actual use for external insulation of existing buildings, which generally must be sold in the form of small sheets, which undesirably increases the number of needed joints.

In the case of existing buildings, the construction elements according to the invention may also be secured as insulation, for example by nailing or crimping, to the interior or the exterior of existing sheathing.

As already mentioned above, the construction element according to the invention may also be used for the construction of flooring. To this end, the insulating elements are assembled and arranged on horizontal supports, so as to constitute a surface adapted to receive either wooden flooring or a covering layer for example in the form of a concrete slab 17. So as to obtain effective connection between the construction element and the concrete, the former is preferably provided with cross members such as were previously described with reference to FIGS. 1–3, which may be transverse (FIG. 9) or longitudinal (FIGS. 10 and 11), and thus serve as anchors in addition to their rigidification function.

Figure 9:
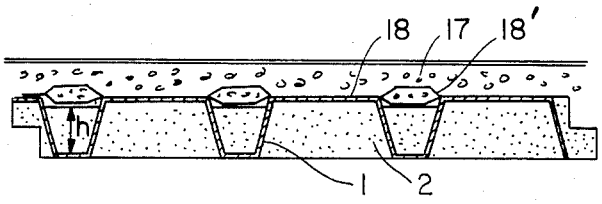
FIGS. 9, 10 and 11 are cross-sectional views of three embodiments of construction element according to the present invention utilizable in the construction of composite flooring.

As transverse connectors can be used for example as metal straps 18 connecting the tops of the ribs of profile 1, these straps having securement portions 18' crossing the longitudinal throats of profile 1 (FIG. 9).

Figure 10:
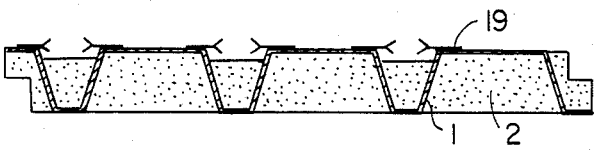

The longitudinal connectors may also be constituted by metal sheets 19 disposed longitudinally on the lateral edges of the tops of the ribs of profile 1, such that a portion of these sheets overlies the longitudinal valleys of profile 1, these overhanging portions being preferably undulant so as to provide better engagement with the concrete (FIG. 10).

Figure 11:
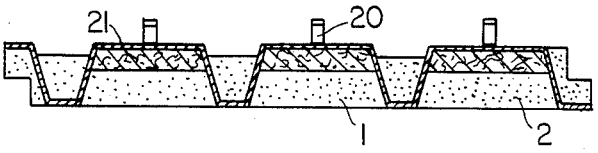

The longitudinal connectors may also be constituted by metal rods 20 preferably twisted and disposed longitudinally along the tops of the ribs of profile 1, on the side intended to receive the concrete (FIG. 11)

As to the distribution of the synthetic insulating material in the embodiments of the construction element according to the invention, on the side of profile 1 opposite that intended to receive the concrete, the insulating material 2 need not completely fill the longitudinal valleys of the profile, the space 21 between the bottom of the valleys and the insulating material 2 being empty or filled with inexpensive filling material.

Moreover, and this is a very important advantage of the construction element according to the invention, the height of filling (h) of the synthetic insulating material 2 of the longitudinal valleys of profile 1 on the side intended to receive the concrete and thus to serve as a form for the latter, may be selected so that the neutral axis of the finished panel (insulating material plus concrete) will be approximately at the level of the upper connectors. Thus, the construction element according to the invention serves not only as formwork but also as a variable shape which can be selected so as to perform other desirable functions.

To illustrate the wide variety of uses possible for the construction element according to the invention, one can also mention that it is equally adaptable to be used for the construction of portable insulating walls, for example anti-noise walls, closure walls, bathroom walls, bomb shelter walls, etc.

A portable wall may be provided by the assembly of construction elements which themselves serve as reinforcement, their lower end being fixed to a base by simple securement in the concrete of a slab. The elements are in this case provided if desired with external and internal facings according to the type of construction in question. On the other hand, the assembly of construction elements may be used, as described in connection with FIGS. 9-11, for the production of flooring, as scaffolding for concrete construction, and as an insulating plate for supporting closures.

In addition to the numerous advantages of the construction element according to the invention already set forth in the preceding, it may also be noted that such elements are easy to construct and that they are therefore inexpensive and particularly suited for low-cost construction, especially in developing countries, while at the same time fulfilling all of the technical and architectural requirements.

From a consideration of the foregoing disclosure, therefore, it will be evident that the object of the present invention has been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A flat modular construction element comprising a rigid core formed of a ribbed sheet at least partially embedded in an insulating material which is a cellular synthetic resin foam, each face of said element being at least partly formed by said insulating material, and connecting elements extending on at least one face of the ribbed sheet and being secured to the tops of the ribs, said connecting elements being spaced from the insulating material so as to be usable for fixing the construction element to a building structure or for securing finishing elements to said construction element.

2. A construction element as claimed in claim 1, in which said connecting elements extend transversely between the tops of said ribs.

3. A construction element as claimed in claim 1, in which said connecting elements extend longitudinally along the tops of the ribs.

4. A construction element as claimed in claim 1 in which said connecting elements are constituted by wooden slats.

5. A flat modular construction element having opposite major faces and comprising a rigid core formed of a ribbed sheet partially embedded in an insulating material which is a cellular synthetic resin foam, one said major face of said element being entirely formed by said insulating material and the other said major face being comprised partly by the tops of the ribs and partly by said insulating material, and connecting elements extending on said other major face of the ribbed sheet and being secured to the tops of the ribs, said connecting elements being usable for fixing the construction element to a building structure or for securing finishing elements to said construction element.

6. A construction element as claimed in claim 5, said connecting elements being spaced from the insulating material.

* * * * *